United States Patent [19]

Fujiwara et al.

[11] 4,427,314

[45] Jan. 24, 1984

[54] SPEED CONTROLLED PRINTER

[75] Inventors: Hitoshi Fujiwara; Kozo Kodaira, both of Shiojiri, Japan

[73] Assignees: Epson Corporation, Nagano; Kabushiki Kaisha Suwa Seikosha, Tokyo, both of Japan

[21] Appl. No.: 320,047

[22] Filed: Nov. 10, 1981

[30] Foreign Application Priority Data

Nov. 11, 1980 [JP] Japan ..... 55-158724

[51] Int. Cl.[3] ..... B41J 19/02; B41J 3/36

[52] U.S. Cl. ..... 400/338.2; 400/88; 400/120; 400/121; 400/314; 400/317.2; 400/336

[58] Field of Search ..... 400/88, 314, 317.2, 400/323.1, 120, 124, 121, 323, 338.2, 336, 336.1

[56] References Cited

U.S. PATENT DOCUMENTS

| | | | |
|---|---|---|---|
| 744,424 | 11/1903 | Steiger | 400/338.2 |
| 2,905,302 | 9/1959 | Hickerson | 400/336.1 X |
| 2,917,151 | 12/1959 | Lambert | 400/336.1 |
| 3,767,020 | 10/1973 | Rowe | 400/124 |
| 3,826,915 | 7/1974 | Giolitti et al. | 400/121 X |
| 3,881,587 | 5/1975 | Okabe | 400/121 X |
| 4,134,696 | 1/1979 | Hanakata et al. | 400/323 |
| 4,198,170 | 4/1980 | Decker | 400/323 |
| 4,310,256 | 7/1982 | Inoue | 400/317.2 X |

FOREIGN PATENT DOCUMENTS

| | | | |
|---|---|---|---|
| 2939206 | 4/1981 | Fed. Rep. of Germany | 400/88 |
| 56-67282 | 6/1981 | Japan | 400/88 |
| 2078616 | 1/1982 | United Kingdom | 400/88 |

*Primary Examiner*—Clifford D. Crowder

*Attorney, Agent, or Firm*—Blum, Kaplan, Friedman, Silberman & Beran

[57] ABSTRACT

A manually operated dot printer designed for use in a pocket-sized calculator or a small-sized electronic device includes a printing head which is manually driven across the dot printer paper in one direction to store energy in springs. The springs return the printing head in steps intermittently while the printing head effects printing on the printing paper. The springs also feed the printing paper. While the printing head is manually moved, the printing elements are maintained out of contact with the printing paper. During return movement of the printing head, the printing elements are in contact with, or nearly in contact with, the printing paper for printing operations. The actual printing operations of the printing head are performed with electrical control using elements of low power consumption.

8 Claims, 10 Drawing Figures

FIG. 1a
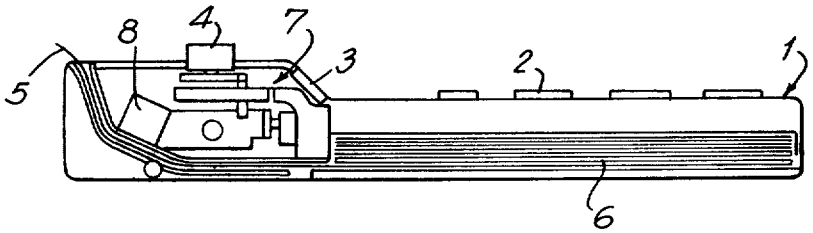
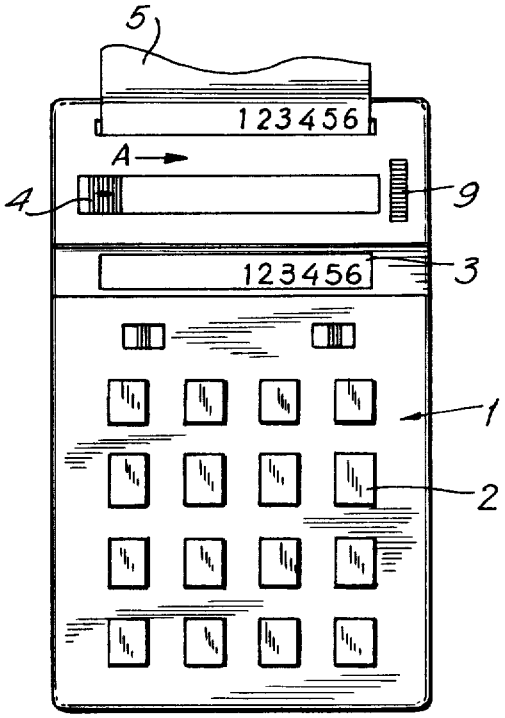
FIG. 1b

SPEED CONTROLLED PRINTER

BACKGROUND OF THE INVENTION

This invention relates generally to a dot printer and more particularly to a manually operated dot printer designed for low power consumption, and a printing method utilizing said dot printer. Conventional manually operated printers, as represented by Japanese Utility Model Laid-Open Publication No. 50-53244, produce printing under pressure or drive a printing wheel using energy stored in a spring due to applied pressure. Such printers require two or three SUM-3 cells for generating energy to select characters on the printing wheel in addition to the manually produced energy. These printers cannot be incorporated into pocket-sized calculators. Pocket-sized calculators with printers of the discharge printing type or the thermal printing type consume a great amount of energy, which is necessary for moving the printing head and feeding the printing paper. Accordingly, these printers require frequent replacement of electrical cells, and this disadvantage renders the calculators unsatisfactory from a practical point of view.

What is needed is a dot printer which is pocket-sized and has low power consumption.

SUMMARY OF THE INVENTION

Generally speaking, in accordance with the invention, a dot printer especially suitable for pocket-sized applications is provided. The dot printer is manually operated and includes a printing head which is manually actuatable across the dot printer in one direction to store energy in springs. The springs release the energy for returning the printing head in intermittent steps while the printing head effects printing on printing paper. The stored energy is also used for feeding the printing paper. While the printing head is manually moved, printing elements are kept out of contact with the printing paper, and during the return movement of the printing head, the printing elements are positioned in contact with or nearly in contact with the printing paper for the printing operation.

The method utilizing a manually operated dot printer having a printing head and spring means comprises the steps of manually moving the printing head in one direction to store energy in the spring means, and effecting electrically controlled printing operations with dots produced by the printing head while the printing head is being moved by the stored energy in the opposite direction.

Accordingly, it is an object of this invention to provide an improved method and apparatus for a manually operated dot printer designed for low power consumption and for use in a pocket-sized calculator.

Another object of this invention is to provide an improved method and apparatus for a manually operated dot printer for use in a low-profile pocket-sized calculator, or other small-sized electronic device, which is manually actuatable or operates with energy stored by manual operation except for the printing operation, which is electrically performed.

A further object of this invention is to provide an improved method and apparatus for a manually operated dot printer which performs non-mechanical dot-printing operations using a discharge, thermal, laser or ink jet process having low power consumption.

Still other objects and advantages of the invention will in part be obvious and will in part be apparent from the specification.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1*a* is a cross-sectional view of a pocket-sized calculator in accordance with this invention;

FIG. 1*b* is a plan view of the pocket-sized calculator of FIG. 1*a;*

DESCRIPTION OF THE PREFERRED EMBODIMENTS

Figure 2:
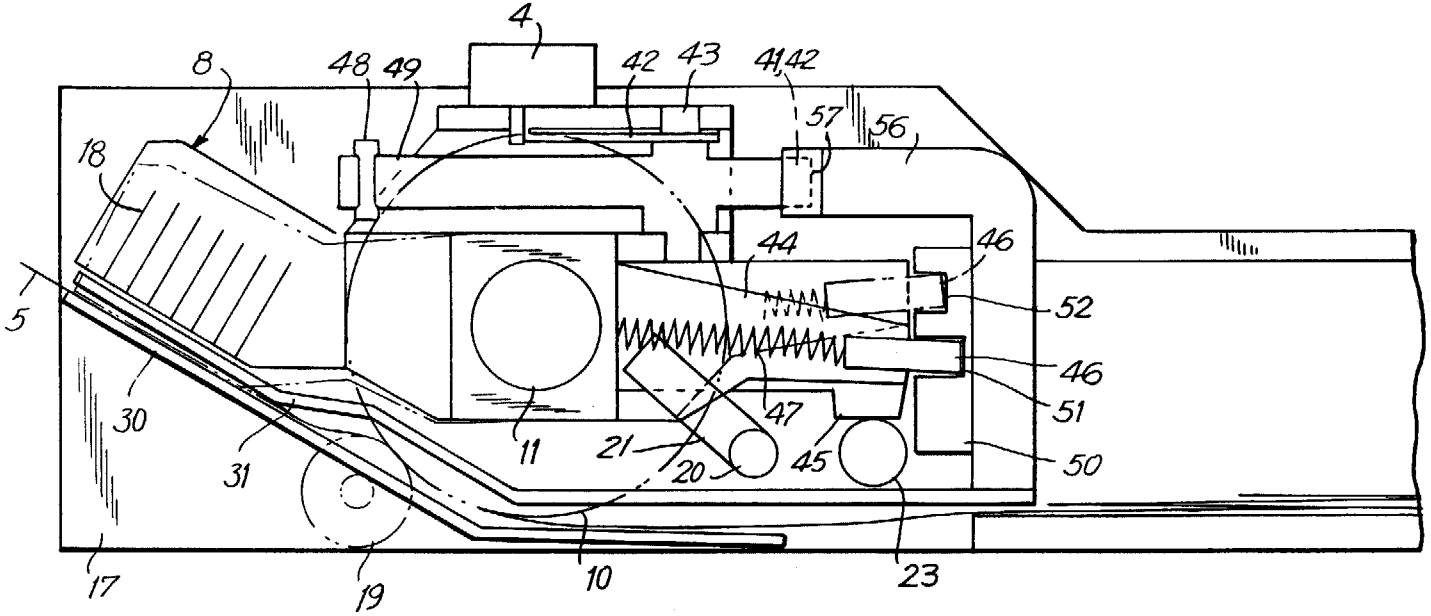
FIG. 2 is a side elevational view of a manually operated dot printer in accordance with the invention.

With reference to FIGS. 1*a* and 1*b*, an electronic calculator 1 comprises a keyboard 2, a display 3, a manually actuatable knob 4 extending above an upper surface of the calculator 1 for manually moving a dot printer 7, including electrical control, incorporated in the calculator 1. The calculator also comprises a sheet 5 of printing paper on which characters are to be printed by the manually operated dot printer 7, fan-folded paper 6, which is an extension of the printing paper 5, and a printing head 8 having printing elements of the discharge, thermal or ink jet type.

In operation, selected keys on the keyboard 2 are depressed for calculation of data in the calculator 1, and calculator results are indicated on the display 3 by conventional methods, such as a liquid crystal display. When such calculated results are also to be recorded on the paper 5, the manual knob 4 is manually moved in the direction of the arrow A. When the knob 4 is released, the knob 4 is caused to return to a starting position while at the same time the same characters as those on the display 3 are printed on the printing paper 5, which is subsequently fed by paper-feed means. When it is required to feed the fan-folded paper 6 to a position in which printing is to be effected, the knob 4 may be moved to feed the paper with the movement of the printing head while the printing head performs no printing, or the paper-feed knob 9 may be manually turned. For rapid feeding of the paper, it is generally more convenient to actuate the paper-feed knob 9.

The manually operated dot printer in accordance with the invention and a printing process utilizing the dot printer are described with reference to FIGS. 2–9. The manually operated dot printer includes a paper-feed roller 10 against which a sheet 5 of printing paper is pressed by a pressure roller 19. The printing head 8 is movable by oscillation and translation on a guide shaft 11, and the paper-feed roller 10 is rotationally moved on a paper-feed shaft 12 having a paper-feed ratchet wheel 13 mounted thereon. The shafts 11, 12 are coaxial with each other.

A paper-feed pawl 14 is mounted on a paper-feed member 15 for angularly moving the ratchet wheel 13 one pitch distance, that is, one tooth at a time.

Side frames 16, 17, the shafts and subframes together constitute an over-all frame for the printer. Printing elements 18 in the printing head 8 may comprise, for example, electrodes for a dot discharge method, or heater elements for a thermal method. It should be understood that other heads, for example, for ink jet printing, can also be incorporated.

Figure 3:
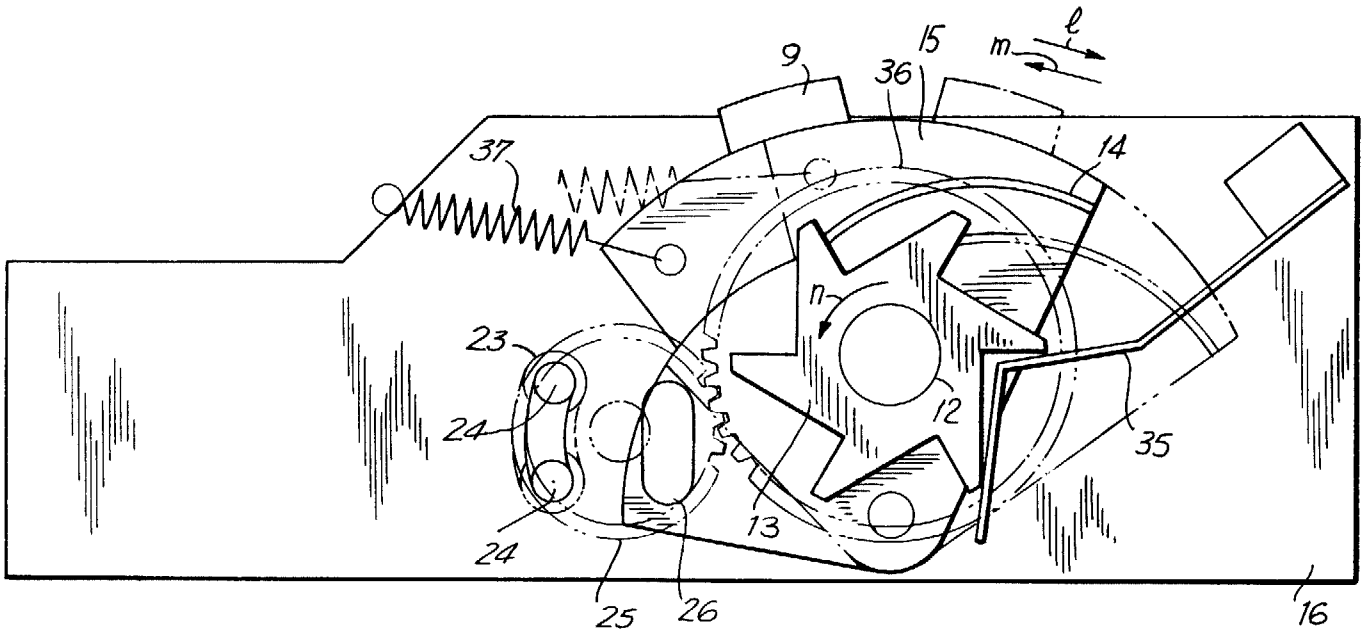
FIG. 3 is the other side elevational view of the manually operated dot printer of FIG. 2.

A control plate 21 is fixed to a control shaft 20 which controls the paper-feed member 15 and is biased in the direction of the arrow G by a control spring 22. A holder 26 holds the paper-feed member 15 in the position shown in solid lines in the drawing (FIG. 3). A paper-feed drive shaft 23 rotates a paper-feed gear 25, engaging the paper-feed member gear 36, and hence the paper-feed member gear 36 to move the paper-feed member 15 from the solid-line position to the broken-line position (FIG. 3). A spring 35 prevents the paper-feed ratchet wheel 13 from rotating backwards. The sheet 5 of printing paper is guided by paper guides 30, 31.

Figure 4:
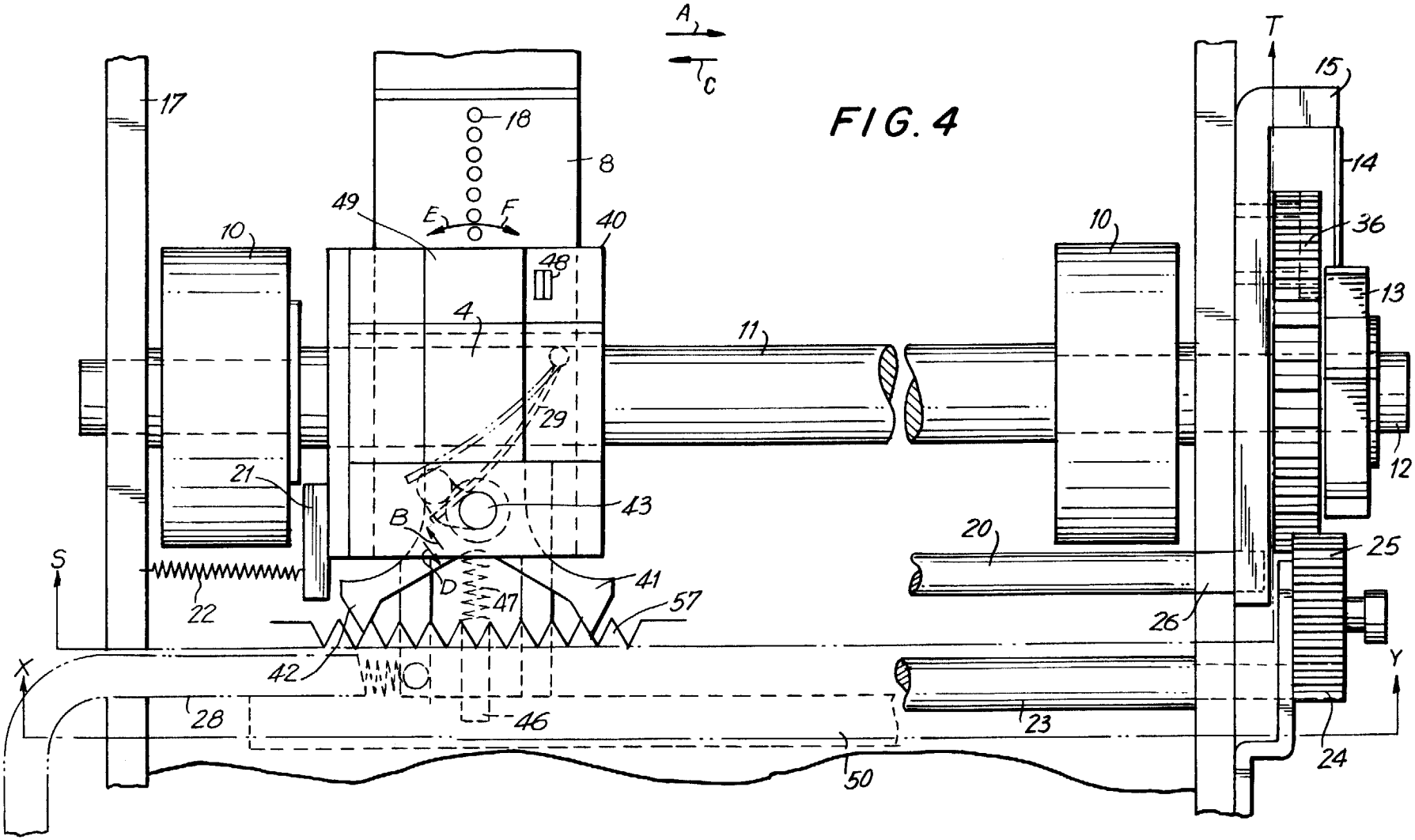
FIG. 4 is a partial plan view of the manually operated dot printer of FIG. 2.
Figure 5:
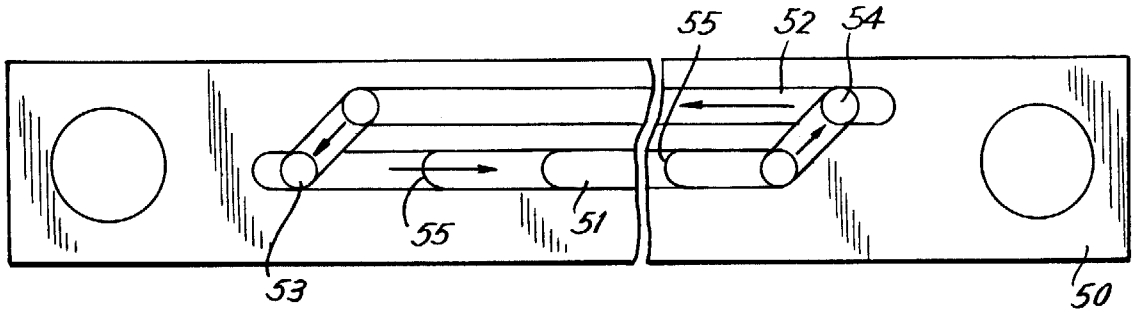
FIG. 5 is a partial rear view of the manually operated dot printer of FIG. 2.

A printing head body 40, which includes the printing head 8, travels on and along the guide shaft 11 with the movement of the manual knob 4. A rocker 49 is pivotably mounted by a pivot pin 43 on the printing head body 40 and has a pair of rocker pawls 41, 42 held in engagement with teeth 57 of a rack on a subframe 56 (FIG. 4). A rocker spring 29 normally biases the rocker pawls 41, 42 into engagement with the teeth 57 during a required interval of time as explained hereinafter. A slide guide member 44 serves to guide a slide 45 for allowing sliding movement of the printing head 8, and supports a guide pin 46 through a guide spring 47. Detector means 48 detect reciprocating movement of the rocker 49 for producing electrical pulses, each pulse corresponding to one dot interval of the printing elements 18. Thus, timing of the printing operation of the printing head 8 is detected.

A guide plate 50 has guide grooves for guiding the guide pin 46. A guide groove 53 receives the guide pin 46 when the printing head 8 is in a standby position. The guide pin 46 moves in and along the guide groove 51 (FIG. 5) while the print head 8 is caused to move forward by the manual knob 4. A return spring 28 is tensioned in the process. The guide pin 46 is in the groove 54 when the printing head 8 is about to start printing in the return direction. The guide groove 52 allows the printing head 8 to return to the standby position under the force of a return spring 28 for the distance in which printing can be effected. The guiding groove 51 has a plurality of stops 55 therein to prevent the printing head 8 from returning to the standby position unless and until the printing head 8 reaches a position where the guide pin 46 is in the return starting groove 54.

The manually operated dot printer thus constructed operates as follows. When it is desired to record results or procedures of calculation in the calculator 1, the manual knob 4 is manually moved in the direction of the arrow A to start operation of the dot printer. As the manual knob 4 is thus manually moved, the printing head body is caused to travel on the guide shaft 11 while at the same time the pin 46 moves from the groove 53 via the groove 51 to the groove 54, whereupon the printing head 8 is in a position to start printing.

While the guide pin 46 moves along the groove 51 to the groove 54, the printing head 8, as it travels, is maintained in the upper position indicated by the solid line in FIG. 2, that is, spaced out of contact with the printing paper 5. Thereby, printing operations are prevented. When the printing head body 40 is released of the manual force and the guide pin 46 is caused by the return spring 28 to move from the groove 54 via the groove 52 to the groove 53 (FIG. 5), the printing head 8 is brought into contact or nearly into contact with the printing paper 5 as shown by the broken-line position of the head 8 in FIG. 2. This is accomplished under control of the guide pin 46 operating in these grooves 54, 52, 53, which cause the head 8 to pivot about the axis of the shaft 11.

With the stoppers 55 in the groove 51, the printing head body 40 is prevented from returning along the groove 51 under the force of the return spring 28 for a printing operation unless the guide pin 46 is manually moved into the groove 54. When the printing head body 40 is manually moved in the direction of the arrow A, the pivot pin 43 is displaced in the direction of the arrow B against the force from the rocker spring 29 to the extent that the rocker pawls 41, 42 are held out of engagement with the teeth 57. The rocker pawls 41, 42 are maintained out of engagement with the teeth 57 until the guide shaft 46 reaches the guide groove 54 as the knob 4 is manually moved. Upon arrival of the shaft 46 at the groove 54, the printing head body 40 is prevented from moving further in the direction of the arrow A, whereupon the pin 43 is displaced in the direction of the arrow D (FIG. 4) due to the resiliency of the rocker spring 29. Thus, the rocker pawls 41, 42 engage the teeth 57. Upon release of the manual force on the manual knob 4, the printing head body 40 starts moving in the direction of the arrow C under the force of the spring 28. The rocker pawls 41, 42 alternately engage the teeth 57 to thereby cause the rocker 49 to be pivoted back and forth in the directions of the arrows E, F. The printing elements 18 of the printing head 8 are thus fed along intermittently by increments corresponding to at least one dot interval.

Such pivoting movements of the rocker 49 in the directions E, F are detected by a detector 48 which produces electrical signals by circuit means (not shown), each signal indicative of printing for a one-dot interval, such that printing with the correct dot intervals is effected. Intermittent movement of the printing head body 40 is rendered smoother by attaching a resistive body to the rocker 49. The pivoting angular movements of the rocker 49 in the directions E, F are repeated until the guide shaft 46 on the printing head body reaches the groove 53. Thereupon, the intermittent movement of the printing head body 40 stops to complete the printing operation. During the printing operation, the printing elements are supplied with electrical pulses for printing each time the printing head 8 moves one lateral increment, thereby printing a character with a plurality of printed dots, for example, a matrix of $5 \times 7$ dots. The printing elements used may be of any known low power consumption type such as, for example, discharge, thermal, laser, or ink jet printing elements. Thus, a printing operation is performed while the printing head 8, powered by the return spring 28, travels intermittently with the guide shaft 46 moving back from the groove 54 via the groove 52 to the groove 53.

Figure 6:
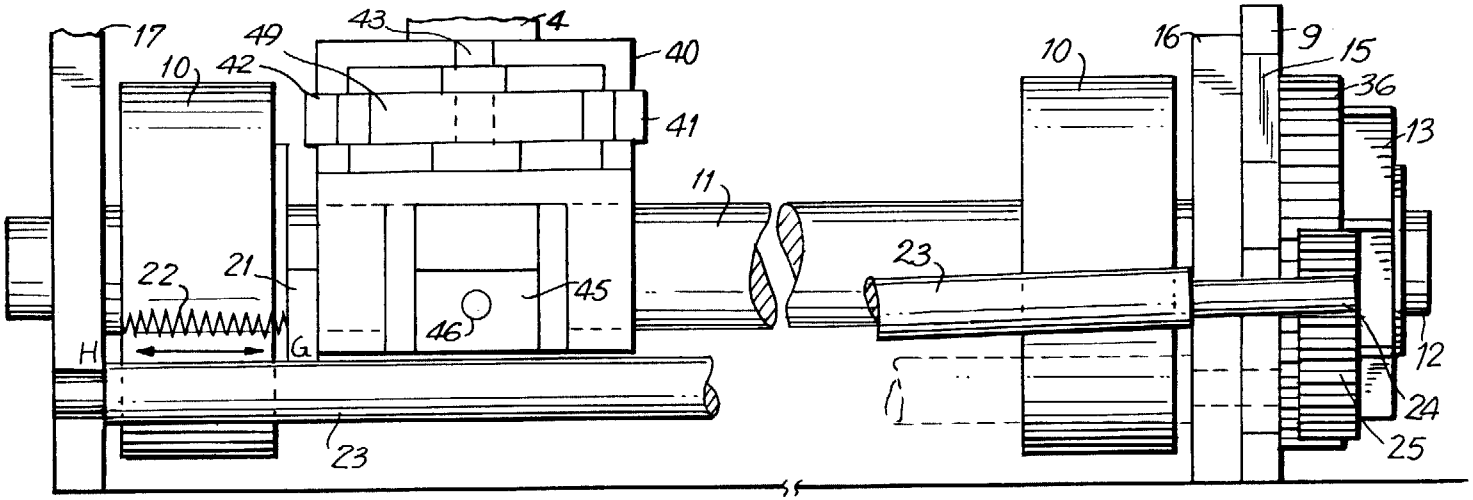
FIGS. 6 and 8 are cross-sectional views taken along line X-Y of FIG. 4.
Figure 7:
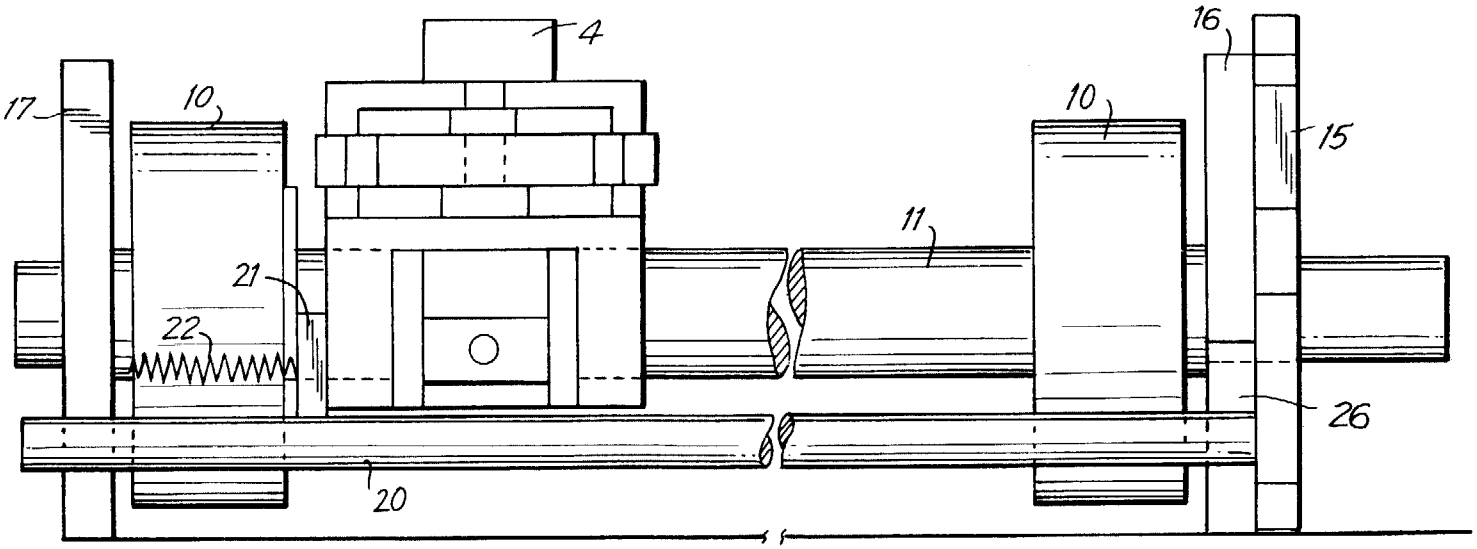
FIGS. 7 and 9 are cross-sectional views taken along line S-T of FIG. 4.

The printing paper 5 on which printing has been accomplished is fed out by rotation of the paper-feed shaft 12 through a given angle, which motion rotates the paper-feed roller 10. Such paper-feeding operation is described in more detail with reference to FIGS. 6–9. With reference to FIG. 6, when the printing head body 40 is in the standby position, the paper-feed drive shaft 23 is depressed by the bottom of the slide guide member 44 of the print head body 40. At this time, the paper-feed drive shaft 23 is in the position shown in the solid lines of FIGS. 3 and 6, with an end 24 of the shaft 23 biased upwardly under the force of a spring 37 applied in the direction of the arrow m on the end 24 through the paper-feed member 15, the paper-feed member gear 36 and the paper-feed gear 25. The printing head body 40, when in the standby position, urges, with a side thereof, the control plate 21 in the direction of the arrow H, while the control spring 22 normally biases the control plate 21 in the direction of the arrow G. The printing head body 40 is normally biased in the direction H by the return spring 28, which is stronger in resiliency than the control spring 22.

As the manual knob 4 is actuated to move the printing head body 40 toward the side frame 16, the bottom of the slide guide member 44 depresses the paper-feed drive shaft 23 to turn the paper-feed gear 25 gradually, thereby angularly moving the paper-feed member 15 in the direction of the arrow l against the force from the paper-feed spring 37.

Figure 8:
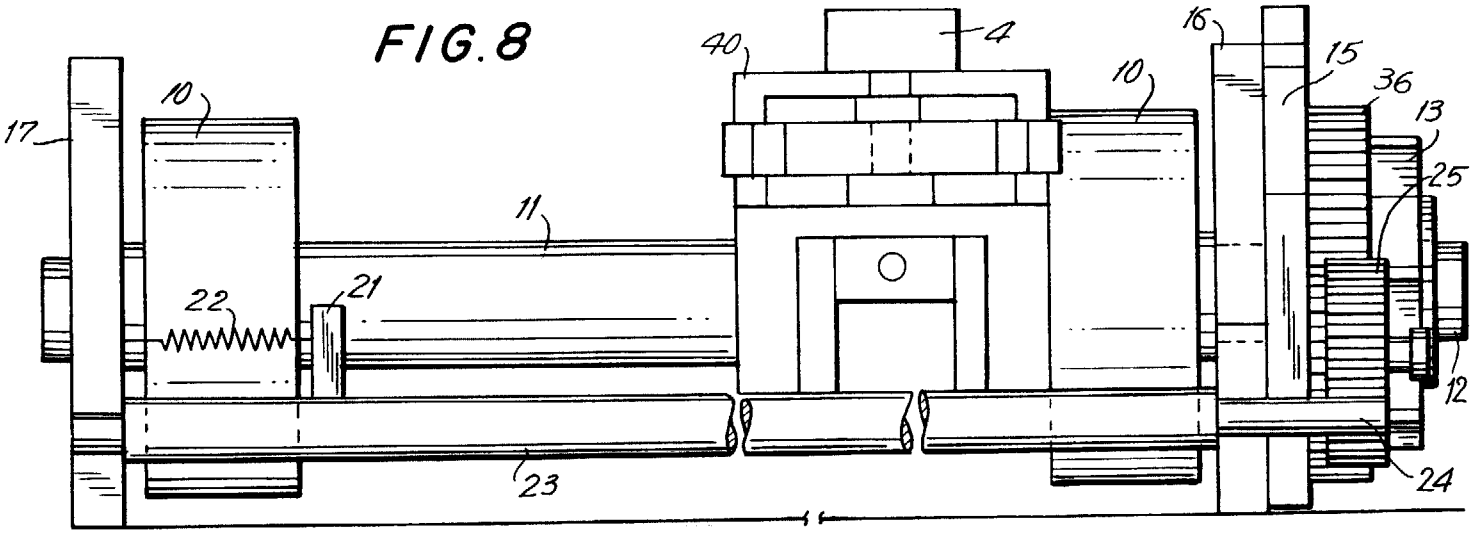
Figure 9:
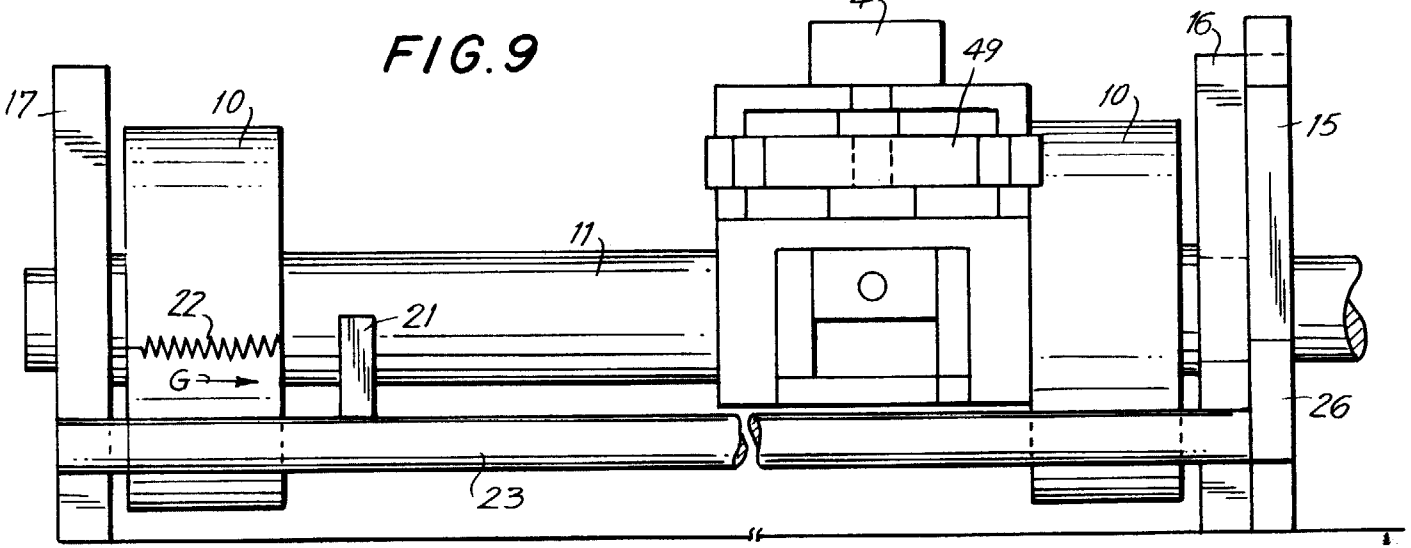

Upon completion of movement of the printing head body 40 toward the side frame 16, as illustrated in FIG. 8, the end 24 of the paper-feed drive shaft 23 has shifted to the broken-line position shown in FIG. 3, whereupon the paper-feed member 15 and the paper-feed pawl 14 thereon are moved to their broken-line positions. As the paper-feed member 15 is pivotably moved in the direction l, the holder 26 on one end of the control shaft 20 is shifted to the position shown in FIG. 9 under the force of the spring 22 applied in the direction G until the holder 26 engages the paper-feed member 15 to hold the latter against further angular movement in the direction m.

In summary, manual operation of the knob 4 to move the printing head body 40 stores energy in the return spring 28 for returning the printing head body 40 to the starting position and also stores energy in the spring 37 for feeding the printing paper 5. When the manual knob 4 is released of the manual force, the printing head body 40 starts moving back to the initial standby position under the force of return spring 28. When the printing head body is returned to the initial standby position, the side of the printing head body 40 pushes the control plate 21 in the direction H, causing the holder 26 to move back into the position illustrated in FIG. 7 and out of engagement with the paper-feed member 15. The paper-feed member 15 is then angularly moved in the direction m under the force of the spring 37. The ratchet wheel 13 is now turned an angular interval equal to one tooth, that is, one pitch distance, whereupon the shaft 12 is angularly moved in the direction of the arrow n (FIG. 3) through an angle to cause the roller 10 to feed the printing paper 5 for a selected distance. When it is desired to feed the printing paper 5 manually irrespective of printing operation, the paper-feed knob 9 is manually moved in the direction l to allow the printing paper 5 to be fed along under the bias of the spring 37 in the manner described above. The foregoing paper-feeding operation may be repeated for continuously feeding the printing paper 5, which may be fed along in any desired increment for each advance by changing the number of teeth on the ratchet wheel 13. The printing paper 5 may be fed in opposite directions by changing the contour of the teeth of the ratchet wheel 13 and the shape of the spring 35 for preventing the ratchet wheel 13 from turning backwards.

It will thus be seen that the objects set forth above, among those made apparent from the preceding description, are efficiently attained, and since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printer for printing on a recording paper, comprising:

printing head means, said printing head means being mounted for incremental translation relative to said paper for printing a line of characters thereon;

means for translating said printing head means for said printing;

speed control means cooperating with said printing head means, said speed control means controlling the speed of said incremental translation of said printing head means, said speed control means including teeth means and ankle means having at least two ankle pawls for alternate engagement with said teeth means, said incremental movement of said printing head means being caused by said alternate engagement of said ankle pawls with said teeth;

detection means mounted on said printing head means, said detection means providing a signal at each increment of movement of said printing head means for printing, said signals synchronizing actuation of said printing means with each incremental position of said printing head means, said detection means including a lever on and moving with said ankle means, and a detector, said detector detecting a pivoting motion of said lever and producing said signals each corresponding to an incremental movement;

printing means mounted on said printing head means and moving therewith, said printing means printing on said paper when said printing head means is moved for printing.

2. A printer as claimed in claim 1, and further comprising:

means for advancing said paper, said advancement being powered by said energy stored in said printer.

3. A printer as claimed in claim 2, and further comprising means for manually advancing said paper.

4. A printer as claimed in claim 1 or 3, wherein said printing means is electrically operated.

5. A printer as claimed in claim 4, wherein said print means is a dot printer.

6. A printer as claimed in claim 1 or 3, and further comprising means for displacing said printing means from said paper while said print head moves in one direction, and moving said print means toward said paper when said print head moves in the opposite direction.

7. A printer as claimed in claim 1, wherein said means for translating said printing head means includes spring means, said spring means being adapted to store energy when said printing head means is translated in one direction across said paper, said printing head means moving incrementally across said paper in the opposite direction powered by said energy stored in said spring means.

8. A printer as claimed in claim 7 and further comprising means for advancing said paper, said advancement being powered by said energy stored in said spring means.

* * * * *